US010449768B2

(12) United States Patent
Zhang et al.

(10) Patent No.: US 10,449,768 B2
(45) Date of Patent: Oct. 22, 2019

(54) LIQUID EJECTING APPARATUS DRIVING METHOD, AND LIQUID EJECTING APPARATUS

(71) Applicant: SEIKO EPSON CORPORATION, Tokyo (JP)

(72) Inventors: Junhua Zhang, Shiojiri (JP); Kenichi Seguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/710,594

(22) Filed: Sep. 20, 2017

(65) Prior Publication Data

US 2018/0086082 A1 Mar. 29, 2018

(30) Foreign Application Priority Data

Sep. 23, 2016 (JP) ..... 2016-185195

(51) Int. Cl.

| | |
|---|---|
| ***B41J 2/165*** | (2006.01) |
| ***B41J 2/14*** | (2006.01) |
| ***B41J 29/38*** | (2006.01) |
| ***B41J 2/175*** | (2006.01) |

(52) U.S. Cl.

CPC ..... *B41J 2/16535* (2013.01); *B41J 2/14201* (2013.01); *B41J 2/16517* (2013.01); *B41J 2/16538* (2013.01); *B41J 2/16552* (2013.01); *B41J 29/38* (2013.01); *B41J 2/17563* (2013.01); *B41J 2002/16558* (2013.01)

(58) Field of Classification Search

CPC ..... B41J 2/16517; B41J 2/16552; B41J 2002/16558

See application file for complete search history.

(56) References Cited

U.S. PATENT DOCUMENTS 5,725,320 A * 3/1998 Austin ..... B26D 1/405 156/384
5,905,514 A * 5/1999 Rhoads ..... B41J 2/16552 347/31
5,969,731 A * 10/1999 Michael ..... B41J 2/16535 347/33
6,550,885 B2 * 4/2003 Matsumoto ..... B41J 2/16508 347/14

(Continued)

FOREIGN PATENT DOCUMENTS

JP 2001-162813 6/2001

*Primary Examiner* — Julian D Huffman
(74) *Attorney, Agent, or Firm* — Workman Nydegger

(57) ABSTRACT

A method for driving a liquid ejecting apparatus is provided. The apparatus includes a liquid ejecting head having nozzles in a nozzle surface and being configured to eject a liquid from the nozzles, a wiper being used for wiping the nozzle surface, and a maintenance liquid supply mechanism being configured to supply a maintenance liquid with which it is possible to suppress deterioration of recovery performance of, among the nozzles, a defective nozzle from which the liquid is not ejected properly. The method includes: a first liquid ejection of performing liquid ejecting operation to eject the liquid from the nozzles toward a medium; a wiping of performing wiping operation to wipe the nozzle surface by means of the wiper, with the liquid ejecting operation suspended, and put the maintenance liquid into the nozzles; and a second liquid ejection of resuming the liquid ejecting operation after the wiping.

20 Claims, 6 Drawing Sheets

(56) References Cited

U.S. PATENT DOCUMENTS

| | | | | |
|---|---|---|---|---|
| 8,684,494 | B2 * | 4/2014 | Ficarra | B41J 2/16552 347/28 |
| 2002/0171705 | A1 * | 11/2002 | Rhoads | B41J 2/16538 347/28 |
| 2003/0007026 | A1 * | 1/2003 | Matsumoto | B41J 2/16508 347/19 |
| 2013/0213440 | A1 * | 8/2013 | Ohta | C09D 11/30 134/22.11 |
| 2014/0022301 | A1 * | 1/2014 | Ficarra | B41J 2/16538 347/28 |
| 2014/0099150 | A1 * | 4/2014 | Matsumoto | G03G 21/1623 400/619 |

* cited by examiner

LIQUID EJECTING APPARATUS DRIVING METHOD, AND LIQUID EJECTING APPARATUS

BACKGROUND

1. Technical Field

The present invention relates to a method for driving a liquid ejecting apparatus provided with a wiper for wiping a nozzle surface, and the liquid ejecting apparatus.

2. Related Art

An image recording apparatus such as an ink-jet printer and an ink-jet plotter is known as an example of a liquid ejecting apparatus provided with a liquid ejecting head. Recently, such a liquid ejecting apparatus has been applied to various manufacturing apparatuses by utilizing its feature of being able to eject a very small amount of liquid onto a predetermined position accurately. For example, the applications include: a display manufacturing apparatus for manufacturing a color filter for a liquid crystal display, etc.; an electrode forming apparatus for forming electrodes of an organic EL (electroluminescence) display or an FED (surface/plane emission display), etc.; and a chip manufacturing apparatus for producing biochips (biochemical element). An image recording apparatus ejects ink that is in the form of liquid from a liquid ejecting head. A display manufacturing apparatus ejects a solution of R (red), G (green), and B (blue) colorants from a liquid ejecting head. An electrode forming apparatus ejects an electrode material that is in the form of liquid from a liquid ejecting head. A chip manufacturing apparatus ejects a solution of a living organic material from a liquid ejecting head.

A liquid ejecting head mentioned above includes, for example, a nozzle plate that has a nozzle surface with a plurality of nozzle openings, a pressure compartment substrate that has a plurality of spaces formed as pressure compartments in communication with the respective nozzles, a plurality of piezoelectric elements (a kind of actuator) provided for the respective pressure compartments, and the like. A liquid ejecting head gives rise to pressure changes inside pressure compartments by the driving of piezoelectric elements, and ejects liquid droplets from nozzles by utilizing the pressure changes. Vaporization of volatile liquid through nozzles occurs during non-driving, in which no liquid droplets are ejected from the nozzles. Due to the vaporization, the viscosity of the liquid in the nozzles tends to increase. There is a possibility that, as the thickening of the liquid progresses, the increased viscosity will render some nozzles unable to perform liquid ejection properly, meaning a risk of the occurrence of a phenomenon of so-called defective nozzle. To address this problem, an ink-jet recording apparatus according to related art has a structure for supplying a sealing liquid to a nozzle surface by using a roll (a kind of wiper) for wiping the nozzle surface, thereby covering the liquid in the nozzles with the sealing liquid. An example of such an ink-jet recording apparatus is disclosed in JP-A-2001-162813.

The reason why the above-described phenomenon of defective nozzle occurs is not limited to the progression of the thickening of liquid. Another cause is, for example, the settlement of a foreign object or an air bubble, etc. in the neighborhood of a nozzle. Assuming that such a phenomenon of defective nozzle has occurred during print operation of ejecting liquid onto a target medium such as sheets of recording paper, if the print operation continues in a state in which the liquid remains un-ejected from the defective nozzle, the thickening and/or alteration of the liquid in the defective nozzle progresses. This makes the function recovery of the defective nozzle difficult, or even impossible, when cleaning operation, for example, sucking operation, is performed after the print operation for forcibly discharging the liquid from the nozzle. That is, the performance of the function recovery of the defective nozzle deteriorates. The defective nozzle is likely to be exposed to air for a long time during long-time consecutive/continuous print operation. Therefore, in such a case, the thickening of the liquid in the defective nozzle tends to progress. Though it is conceivable to suspend the print operation and perform cleaning operation, the cleaning operation requires a sufficiently long print suspension time. A long suspension gives rise to a discontinuity in the degree of drying of ink between an area having been printed before the cleaning and an area having been printed after the cleaning, resulting in the lack of uniformity on a print output. Therefore, in printing on an elongated print medium, in order to avoid the lack of uniformity on a print output, it is impossible to suspend the print operation and perform cleaning operation. For this reason, the time of no liquid ejection from the defective nozzle during the print operation is long. This makes the function recovery of the defective nozzle difficult in the cleaning operation, which is a problem in related art.

SUMMARY

An advantage of some aspects of the invention is to provide a liquid ejecting apparatus driving method that makes it possible to suppress the deterioration of the performance of the function recovery of the defective nozzle after print operation, especially after printing on an elongated print medium, and to provide a liquid ejecting apparatus.

One aspect of the invention is a liquid ejecting apparatus driving method for driving a liquid ejecting apparatus, the apparatus including a liquid ejecting head, a wiper, and a maintenance liquid supply mechanism, the liquid ejecting head having nozzles in a nozzle surface and being configured to eject a liquid from the nozzles, the wiper being used for wiping the nozzle surface, the maintenance liquid supply mechanism being configured to supply a maintenance liquid with which it is possible to suppress deterioration of recovery performance of, among the nozzles, a defective nozzle from which the liquid is not ejected properly, the method comprising: a first liquid ejection of performing liquid ejecting operation to eject the liquid from the nozzles toward a medium; a wiping of performing wiping operation to wipe the nozzle surface by means of the wiper, with the liquid ejecting operation suspended, and put the maintenance liquid into the nozzles; and a second liquid ejection of resuming the liquid ejecting operation after the wiping.

With the above driving method, even if a phenomenon of defective nozzle occurs before the end of liquid ejecting operation, it is possible to put the maintenance liquid into the defective nozzle and therefore possible to suppress the deterioration of recovery performance of the defective nozzle in the cleaning operation performed after the liquid ejecting operation.

Another aspect of the invention is a liquid ejecting apparatus driving method for driving a liquid ejecting apparatus, the apparatus including a liquid ejecting head, a wiper, and a maintenance liquid supply mechanism, the liquid ejecting head having nozzles in a nozzle surface and being configured to eject a liquid from the nozzles, the wiper being used for wiping the nozzle surface, the maintenance liquid supply mechanism being configured to supply a maintenance liquid that contains a surface-active agent, the method comprising: a first liquid ejection of performing liquid ejecting operation to eject the liquid from the nozzles toward a medium; a wiping of performing wiping operation to wipe the nozzle surface by means of the wiper, with the liquid ejecting operation suspended, and put the maintenance liquid into the nozzles; and a second liquid ejection of resuming the liquid ejecting operation after the wiping.

With the above driving method, even if a phenomenon of defective nozzle occurs before the end of liquid ejecting operation, it is possible to put the maintenance liquid containing the surface-active agent into the defective nozzle and therefore possible to increase the amount of the surface-active agent contained in the liquid in the defective nozzle. As a result, it is easier for the thickened liquid or foreign object, etc. to be released from the wall surface, etc. of the nozzle, thereby suppressing the deterioration of recovery performance of the defective nozzle in the cleaning operation performed after the liquid ejecting operation.

In the above driving method, preferably, the liquid should contains a surface-active agent; the surface-active agent contained in the maintenance liquid should be the same material as the surface-active agent contained in the liquid; and concentration of the surface-active agent contained in the maintenance liquid should be higher than concentration of the surface-active agent contained in the liquid.

With the above driving method, it is possible to suppress the deterioration of liquid reliability.

Still another aspect of the invention is a liquid ejecting apparatus driving method for driving a liquid ejecting apparatus, the apparatus including a liquid ejecting head, a wiper, and a maintenance liquid supply mechanism, the liquid ejecting head having nozzles in a nozzle surface and being configured to eject a liquid from the nozzles, the wiper being used for wiping the nozzle surface, the maintenance liquid supply mechanism being configured to supply a maintenance liquid that is less volatile than the liquid and does not mix well with the liquid, the method comprising: a first liquid ejection of performing liquid ejecting operation to eject the liquid from the nozzles toward a medium; a wiping of performing wiping operation to wipe the nozzle surface by means of the wiper, with the liquid ejecting operation suspended, and put the maintenance liquid into the nozzles; and a second liquid ejection of resuming the liquid ejecting operation after the wiping.

With the above driving method, even if a phenomenon of defective nozzle occurs before the end of liquid ejecting operation, it is possible to put the maintenance liquid into the defective nozzle and therefore possible to keep the maintenance liquid on the surface of the liquid in the defective nozzle, thereby reducing the vaporization of the liquid from the defective nozzle. Consequently, it is possible to retard the thickening of the liquid in the defective nozzle and suppress the deterioration of recovery performance of the defective nozzle in the cleaning operation performed after the liquid ejecting operation.

In any of the above driving method, preferably, the liquid ejecting apparatus should further include a nozzle inspection mechanism configured to detect the defective nozzle from which the liquid is not ejected properly; and, in the wiping, the wiping operation should be performed in a case where the defective nozzle is detected by the nozzle inspection mechanism.

With the above driving method, it is possible to suppress the deterioration of the performance of the function recovery of the defective nozzle which would otherwise occur when the defective nozzle is left unattended for a long time.

In the above driving method, preferably, an amount of the maintenance liquid put into the nozzles in the wiping should be adjusted depending on a length of time from the detection of the defective nozzle by the nozzle inspection mechanism to scheduled completion of the liquid ejecting operation onto the medium.

With the above driving method, it is possible to reduce the consumption of the maintenance liquid.

Preferably, any of the above driving method should further comprise: a flushing of performing, after the wiping and before the second liquid ejection, flushing operation to eject the liquid from the nozzles toward an area outside an area of the medium, wherein, in the flushing, the liquid is not ejected from the defective nozzle.

With the above driving method, it is possible to prevent liquid that is to be ejected from normal nozzles in the liquid ejecting operation after the wiping operation from substantially containing the maintenance liquid. Consequently, the quality of an image will not be decreased.

A liquid ejecting apparatus according to one aspect of the invention comprises: a liquid ejecting head that has nozzles in a nozzle surface and ejects a liquid from the nozzles; a wiper that wipes the nozzle surface; and a maintenance liquid supply mechanism that supplies, either to the nozzle surface or to the wiper, or to both, a maintenance liquid with which it is possible to suppress deterioration of recovery performance of, among the nozzles, a defective nozzle from which the liquid is not ejected properly, wherein there is an operation mode of, in a state in which liquid ejecting operation of ejecting the liquid from the nozzles toward a medium has been suspended, performing wiping operation to wipe the nozzle surface by means of the wiper and put the maintenance liquid into the nozzles, and resuming the liquid ejecting operation after the wiping.

A liquid ejecting apparatus according to another aspect of the invention comprises: a liquid ejecting head that has nozzles in a nozzle surface and ejects a liquid from the nozzles; a wiper that wipes the nozzle surface; and a maintenance liquid supply mechanism that supplies, either to the nozzle surface or to the wiper, or to both, a maintenance liquid that contains a surface-active agent, wherein there is an operation mode of, in a state in which liquid ejecting operation of ejecting the liquid from the nozzles toward a medium has been suspended, performing wiping operation to wipe the nozzle surface by means of the wiper and put the maintenance liquid into the nozzles, and resuming the liquid ejecting operation after the wiping.

A liquid ejecting apparatus according to still another aspect of the invention comprises: a liquid ejecting head that has nozzles in a nozzle surface and ejects a liquid from the nozzles; a wiper that wipes the nozzle surface; and a maintenance liquid supply mechanism that supplies, either to the nozzle surface or to the wiper, or to both, a maintenance liquid that is less volatile than the liquid and does not mix well with the liquid, wherein there is an operation mode of, in a state in which liquid ejecting operation of ejecting the liquid from the nozzles toward a medium has been suspended, performing wiping operation to wipe the nozzle surface by means of the wiper and put the maintenance liquid into the nozzles, and resuming the liquid ejecting operation after the wiping.

With the above structure, it is possible to suppress the deterioration of recovery performance of the defective nozzle in the cleaning operation performed after the liquid ejecting operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, some exemplary embodiments of the present invention will now be explained. Various specific features are explained in the following embodiments of the invention for the purpose of disclosing preferred modes thereof. However, the scope of the invention is not limited to the specific embodiments described below unless any intention of restriction is explicitly shown. In the following description, an ink-jet recording apparatus is taken as an example of a liquid ejecting apparatus according to an aspect of the invention. The ink-jet recording apparatus may be hereinafter simply referred to as a "printer".

Figure 1:
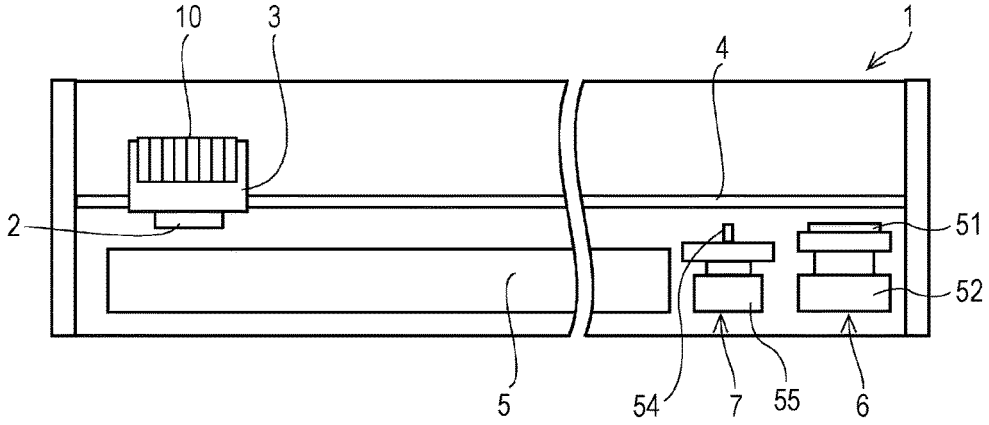
FIG. 1 is a front view for explaining an example of the inner structure of a printer.
Figure 2:
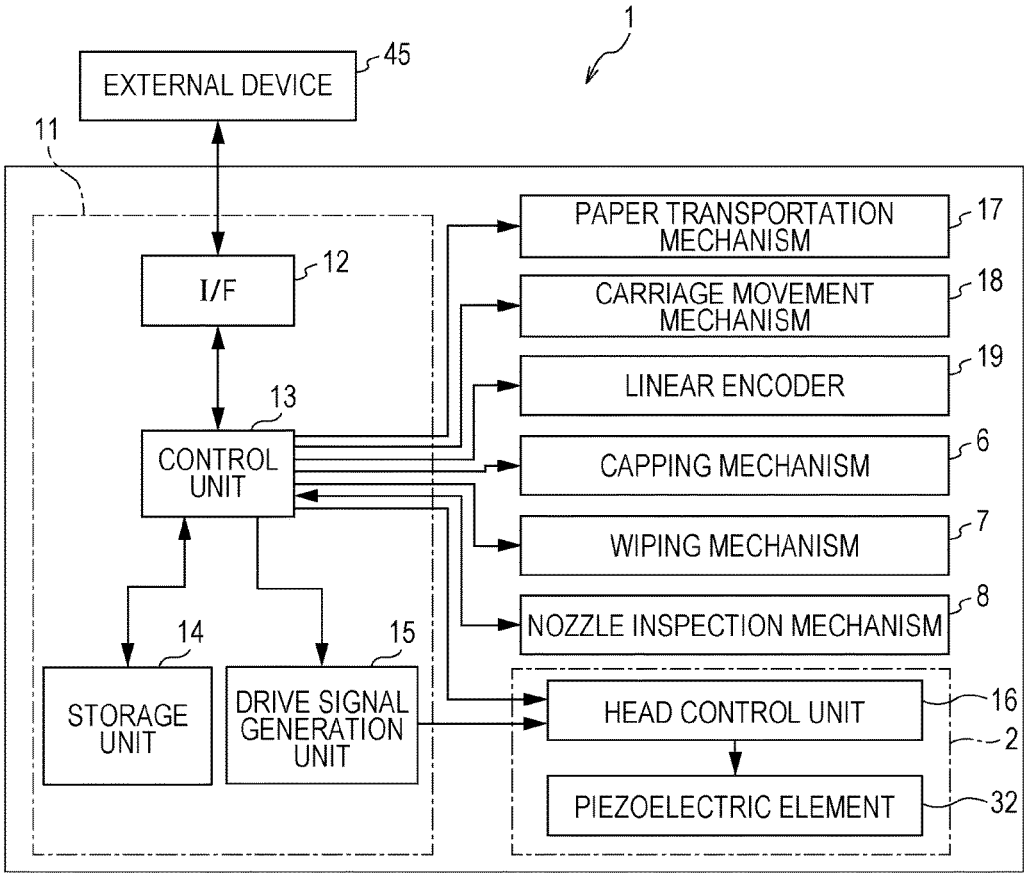
FIG. 2 is a block diagram for explaining an example of the electric configuration of the printer.

FIG. 1 is a front view for explaining an example of the inner structure of a printer 1. FIG. 2 is a block diagram for explaining an example of the electric configuration of the printer 1. A recording head 2, which is a kind of liquid ejecting head, is mounted on the bottom of a carriage 3. Detachable ink cartridges 10 (a kind of liquid supply source) are on the carriage 3. Driven by a carriage movement mechanism 18, the carriage 3 is able to move in a reciprocating manner along a guide rod 4. The printer 1 records an image, etc. by causing a paper transportation mechanism 17 to transport sheets of print paper (print target medium) (a kind of medium in an aspect of the invention) one after another over a platen 5 and by causing the recording head 2 to eject ink (a kind of liquid in an aspect of the invention) from nozzles 35 (see FIG. 4) in such a way that ejected droplets will land onto the print target medium, while moving the recording head 2 relatively in the medium width direction (main scan direction). Instead of the structure described above, the ink cartridges may be attached to the body of the printer, and ink contained in the ink cartridges may be sent via ink supply tubes to the recording head 2. Ink according to the present embodiment contains a surface-active agent, for example, a polysiloxane surface-active agent or an acetylenic glycol surface-active agent.

There is a home position, which is the standby position of the recording head 2, at one end region (right end in FIG. 1) in the main scan direction, not on the platen 5. A capping mechanism 6 and a wiping mechanism 7 are provided at the home position in this order as viewed from the one end. The capping mechanism 6 includes a cap 51, which is an elastic member made of, for example, elastomer, and a pump unit 52. The capping mechanism 6 is able to switch the positional state of the cap 51 between a sealing state (capping state) and a retracted state. In the sealing state, the cap 51 is in hermetic seal contact with the bottom surface (surface facing the print target medium) including the nozzle surface 34 (see FIG. 4) of the recording head 2. In the retracted state, the cap 51 is positioned away from the bottom surface. The pump unit 52 makes the pressure of the inner space of the cap 51 negative in the capping state. That is, when the pump unit 52 is operated in the capping state, the pressure of the inner space of the cap 51 becomes negative, and ink retained in the recording head 2 is sucked out through the nozzles 35 into the inner space of the cap 51. The ink having been discharged into the inner space of the cap 51 is drained to a non-illustrated waste ink tank through a waste ink tube, etc. connected to the cap 51. The above series of operations (processing) performed by the capping mechanism 6 is so-called suction-type cleaning operation (hereinafter may be simply referred to as "cleaning operation"). So-called pressurization-type cleaning operation may be performed instead of suction-type cleaning operation. In the pressurization-type cleaning operation, the ink supply passage upstream of the recording head 2 (portion closer to the ink cartridges 10) is pressurized by means of, for example, an air pump to increase the internal pressure of the flow passages of the recording head 2 so as to discharge ink, etc. through the nozzles 35.

The wiping mechanism 7 of the present embodiment includes a wiper 54 and a maintenance liquid supply unit 55. The wiper 54 is a blade-shaped member that is elongated in the direction orthogonal to the main scan direction, or in other words, in the direction of the nozzle lines of the head unit 20 described later. The maintenance liquid supply unit 55 supplies a maintenance liquid to the wiper 54. The wiping mechanism 7 is able to switch the positional state of the wiper 54 between a state of being in contact with the bottom surface of the recording head 2 and a retracted state, that is, a state of being positioned away from the bottom surface. The wiping mechanism 7 is able to move, in the main scan direction, the wiper 54 positioned in contact with the bottom surface of the recording head 2. The wiper 54 is made of, for example, a porous resin material so as to be able to absorb the maintenance liquid and wipe the bottom surface including the nozzle surface 34 of the recording head 2 while retaining the absorbed maintenance liquid. An endless belt whose surface is covered with a cloth, a blade-shaped elastic member made of an elastomer, etc. and having a surface covered with a cloth, a roll-shaped wiper, or the like can be used as the wiper 54. To sum up, various kinds of structure can be adopted as the structure of the wiper 54 for wiping the nozzle surface 34. In a state in which the wiper 54 is in contact with the bottom surface of the recording head 2, the wiping mechanism 7 moves (slides) either the wiper 54 or the recording head 2 in the main scan direction to wipe the bottom surface including the nozzle surface 34 of the recording head 2. A series of operations (processing) performed by the wiping mechanism 7 described above is called as wiping operation.

The maintenance liquid supply unit 55 (a kind of maintenance liquid supply mechanism in an aspect of the invention) is a unit that includes a pump, and tubes, etc., and supplies a maintenance liquid to the wiper 54 from a non-illustrated tank that contains the maintenance liquid. At least in wiping operation that is performed before the end of print operation, the maintenance liquid supply unit 55 is activated to impregnate the wiper 54 with maintenance liquid, and the nozzle surface 34 is wiped by means of the wiper 54 that is in this state. It is possible to put the maintenance liquid into the nozzles 35 by performing wiping operation in this way. Any structure may be adopted for the wiping mechanism 7 as long as it is possible to put the maintenance liquid into the nozzles 35 by performing wiping operation. For example, the maintenance liquid supply unit may supply maintenance liquid to the nozzle surface 34 directly. That is, the maintenance liquid supply unit supplies a maintenance liquid to either the nozzle surface 34 or the wiper 54, or both. Instead of providing the maintenance liquid supply unit 55 in the wiping mechanism, at least a part of the wiper may be immersed in a maintenance liquid contained in a tank so as to supply the maintenance liquid to the wiper. In such a case, the immersion portion of the tank and the wiper corresponds to the maintenance liquid supply mechanism in an aspect of the invention. A more detailed explanation of wiping operation performed before the end of print operation will be given later.

Maintenance liquid is a liquid with which it is possible to suppress the deterioration of recovery performance of a so-called defective nozzle, that is, the nozzle 35 from which ink is not ejected properly. The maintenance liquid does not necessarily have to contain pigment or resin. Maintenance liquid according to the present embodiment is a liquid that contains a surface-active agent and blends in (mixes with) ink. As the surface-active agent, for example, a polysiloxane surface-active agent or an acetylenic glycol surface-active agent is used. It is preferred that the surface-active agent contained in the maintenance liquid be the same material as the surface-active agent contained in the ink. In addition, it is preferred that the concentration of the surface-active agent contained in the maintenance liquid be higher than the concentration of the surface-active agent contained in the ink. By this means, it is possible to suppress the deterioration of ink reliability. That is, it is possible to increase the amount of the surface-active agent contained in the ink in the nozzle 35 while avoiding the maintenance liquid having mixed with the ink in the nozzle 35 from adversely affecting ink ejection and image quality. Moreover, it is possible to shorten a recording head development period because reliability evaluation for maintenance liquid separately from that of ink is unnecessary. The scope of the disclosure is not limited to the above example. Maintenance liquid that contains a surface-active agent that is different from a surface-active agent contained in ink may be applied to the nozzle 35 from which ink is not ejected properly, thereby suppressing the deterioration of recovery performance of a so-called defective nozzle.

Next, the electric configuration of the printer 1 will now be explained. As illustrated in FIG. 2, the components of a printer 1 according to the present embodiment are controlled by a printer controller 11. The printer controller 11 of the present embodiment includes an interface (I/F) unit 12, a control unit 13, a storage unit 14, and a drive signal generation unit 15. The interface unit 12 receives print data and print instructions from an external device 45 such as a computer or a handheld information terminal, and outputs status information on the printer 1 to the external device 45. The storage unit 14 is a memory element that stores the program of the control unit 13 and data used for various kinds of control. The storage unit 14 includes: a ROM, a RAM, an NVRAM (nonvolatile memory element).

The control unit 13 controls each unit in accordance with the program stored in the storage unit 14. On the basis of print data inputted from the external device 45, the control unit 13 of the present embodiment generates ejection data that indicates from which nozzles 35 of the recording head 2 ink should be ejected during recording operation, and indicates at which timing the ink should be ejected. Then, the control unit 13 transmits the ejection data to a head control unit 16 of the recording head 2. On the basis of an encoder pulse outputted from a linear encoder 19, a timing pulse PTS is generated. In synchronization with the timing pulse PTS, the control unit 13 controls the transfer of print data, and the generation of a drive signal by the drive signal generation unit 15, and the like. In addition, on the basis of the timing pulse PTS, the control unit 13 generates a timing signal such as a latch signal LAT, and outputs the timing signal to the head control unit 16 of the recording head 2. On the basis of the ejection data and the timing signal, the head control unit 16 applies drive pulses in a drive signal selectively to piezoelectric elements 32 (see FIG. 4). As a result of this processing, the piezoelectric elements 32 are driven to eject (discharge) ink droplets from the nozzles 35, or, alternatively, vibration operation that is very fine to the extent that no droplets are ejected is performed. The drive signal generation unit 15 generates a drive signal that includes drive pulses for recording an image, etc. by ejecting ink droplets onto print paper.

As illustrated in FIG. 2, the printer 1 of the present embodiment includes a paper transportation mechanism 17, a carriage movement mechanism 18, a linear encoder 19, a capping mechanism 6, a wiping mechanism 7, a nozzle inspection mechanism 8, and a recording head 2, etc. The carriage movement mechanism 18 includes a carriage 3 on which the recording head 2 is mounted, a drive motor (for example, a DC motor) that causes the carriage 3 to travel by driving the carriage 3 via a timing belt, and the like. Driven by the carriage movement mechanism 18, the recording head 2 mounted on the carriage 3 moves in the main scan direction. The paper transportation mechanism 17 includes a paper transportation motor and a paper transportation roller (neither the motor nor the roller is illustrated). The paper transportation mechanism 17 feeds sheets of print paper onto the platen 5 one after another, and causes the print paper on the platen 5 to move in the sub scan direction. The linear encoder 19 outputs, to the printer controller 11, an encoder pulse corresponding to the scan position of the recording head 2 mounted on the carriage 3 as position information in the main scan direction. On the basis of the encoder pulse received from the linear encoder 19, the control unit 13 of the printer controller 11 is able to obtain information on the scan position (i.e., current position) of the recording head 2.

The nozzle inspection mechanism 8 is an inspection means for detecting a defective nozzle(s) from which ink is not ejected properly. As the nozzle inspection mechanism 8, for example, a mechanism that has the following structure is used: the mechanism includes the nozzle surface 34, a detection surface (not illustrated) facing the nozzle surface 34 and located at a position away from the platen 5, and an inspection circuit (not illustrated), wherein a voltage is applied between the nozzle surface 34 and the detection surface, and the voltage on the detection surface is detected by the inspection circuit. In a state in which the nozzle surface 34 and the detection surface face each other, the nozzle inspection mechanism 8 applies an electric field between the nozzle surface 34 and the detection surface, detects, in the form of a detected waveform, a change over time in a voltage value due to electrostatic induction occurring when ink moves from the nozzle 35 toward the detection surface, and outputs the detected waveform to the control unit 13. It is possible to judge whether ink has been ejected from the nozzle 35 properly or not on the basis of the detected waveform. That is, it is possible to detect the defective nozzle. The detection surface may be provided in, for example, the inner space of the cap 51. The structure of the nozzle inspection mechanism 8 is not limited to the above example. It is possible to adopt various kinds of structure for the nozzle inspection mechanism 8. For example, the defective nozzle may be detected on the basis of the counter electromotive force of the piezoelectric element 32 arising from residual vibration when the piezoelectric element 32 is driven. The defective nozzle may be detected by capturing an image of ink ejected from the nozzle 35 and analyzing the captured image.

Figure 3:
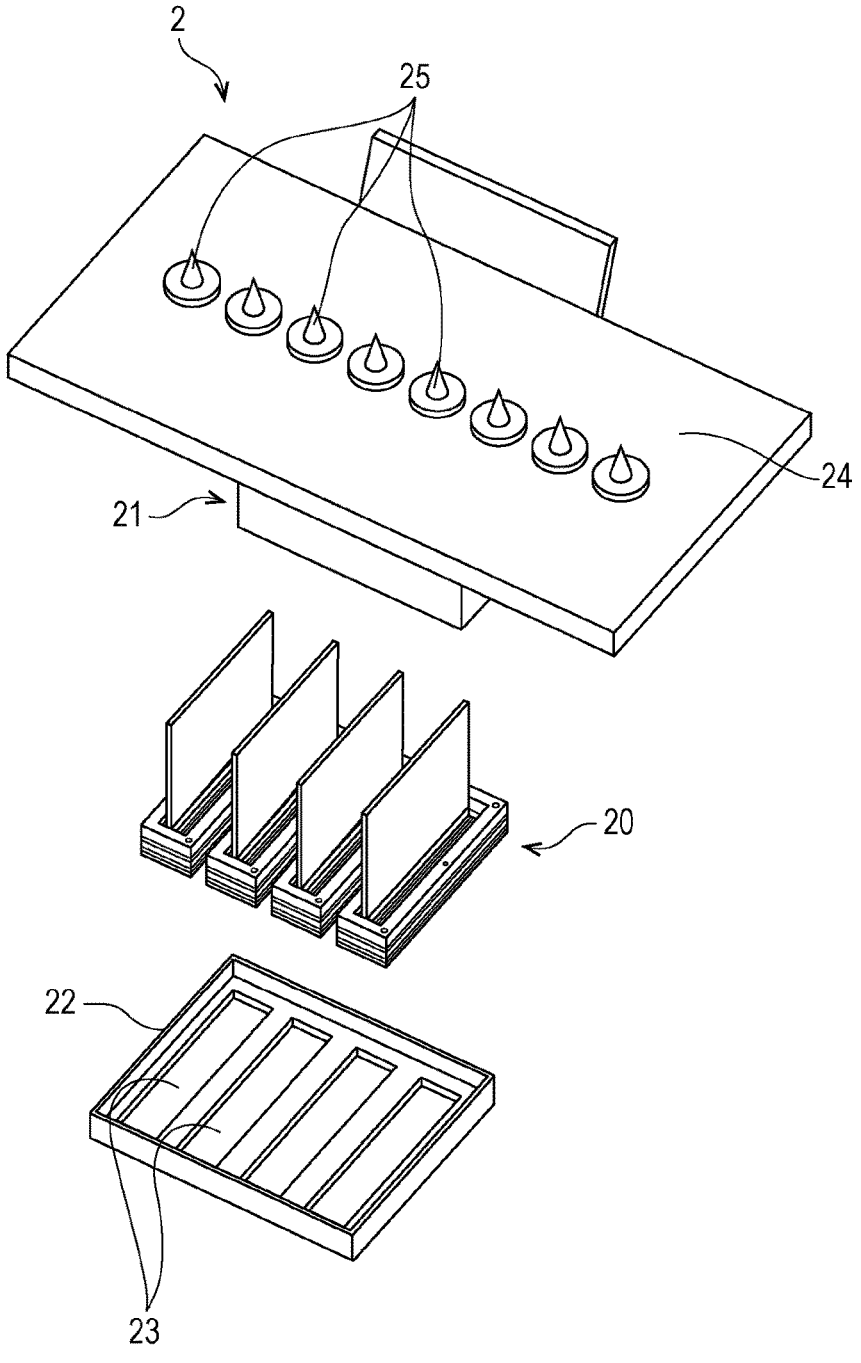
FIG. 3 is an exploded perspective view for explaining an example of the structure of a recording head.
Figure 4:
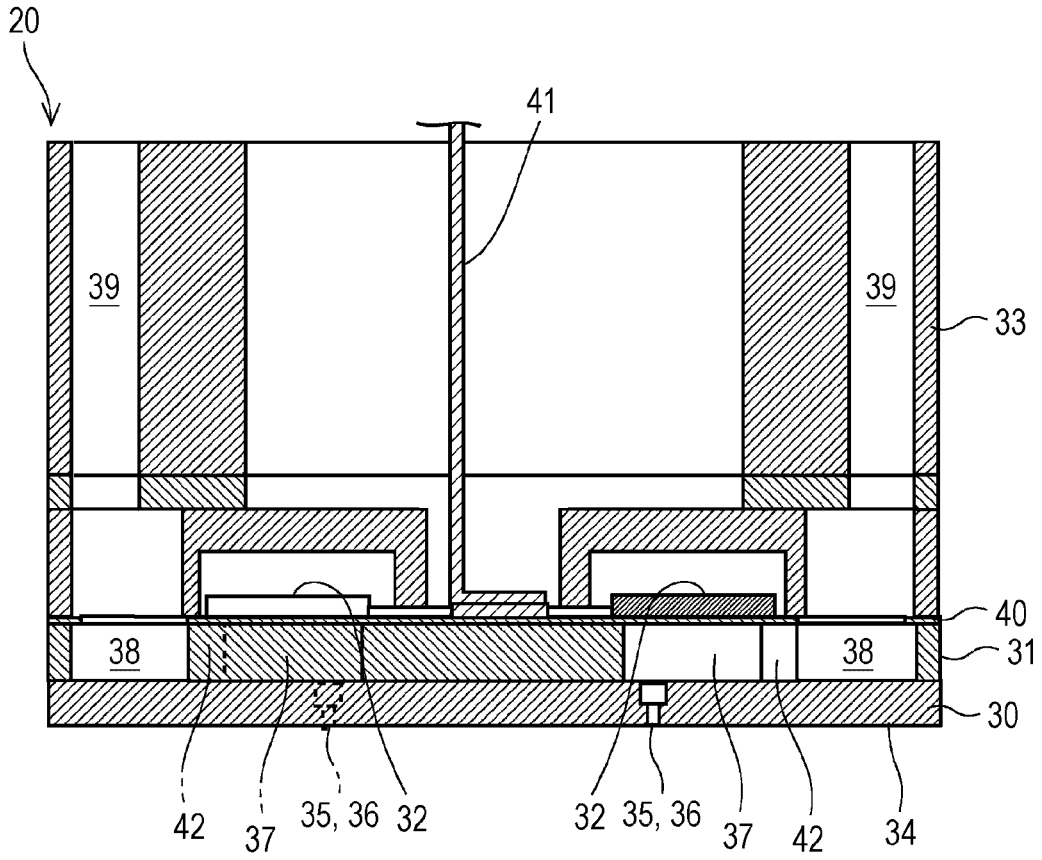
FIG. 4 is a sectional view for explaining an example of the structure of a head unit.

Next, the structure of the recording head 2 will now be explained. FIG. 3 is an exploded perspective view for explaining an example of the structure of the recording head 2. FIG. 4 is a sectional view for explaining an example of the structure of a head unit 20. The recording head 2 of the present embodiment includes a holder 21, a plurality of head units 20, and a fixing plate 22. The holder 21 is a box-shaped member that houses the head units 20 and supply flow passages (not illustrated) through which ink is supplied to the head units 20. An ink inlet unit 24 is provided on the top of the box. The ink inlet unit 24 is a member on which ink inlet needles 25 are provided upright. In the present embodiment, eight ink inlet needles 25 in total are arranged in a line in the main scan direction on the ink inlet unit 24. The ink inlet needle 25 is a member that has a shape of a hollow needle and is connected to an ink cartridge 10. Ink contained in the ink cartridge 10 enters the ink inlet needle 25 and flows into the supply flow passage inside the holder 21, and then flows through the supply flow passage toward the head unit 20. The scope of the disclosure is not limited to the above structure of inserting the ink inlet needle 25 into the ink cartridge 10. For supplying/receiving ink, a porous member that is provided at the flow passage entrance of the ink inlet unit and a porous member that is provided at the flow passage exit of the ink cartridge may be brought into contact with each other.

Plural head units 20 are mounted on the bottom of the holder 21. In the present embodiment, four head units 20 are arranged adjacently in the main scan direction, with their longer sides directed neatly to be orthogonal to the main scan direction. The head units 20 are bonded to the fixing plate 22 after being positioned with respect to one another. The fixing plate 22 is a plate member made of metal, for example, stainless steel (SUS). The fixing plate 22 protects the bottom and sides of the head units 20. The fixing plate 22 has four openings 23 corresponding to the head units 20. The nozzle plate 30 (i.e., nozzle surface 34) of each of the head units 20 is exposed through the corresponding one of the openings 23. Therefore, the nozzles 35 of each of the head units 20 fixed to the holder 21 are exposed through the corresponding one of the openings 23. The number of the head units 20 of the recording head 2 is not limited to four. At least one head unit suffices.

As illustrated in FIG. 4, the head unit 20 of the present embodiment includes a nozzle plate 30, a flow passage substrate 31, piezoelectric elements 32, and a case 33, etc., wherein these members are assembled in layers. The nozzle plate 30 is a plate member through which plural nozzles 35 are formed as orifices at a predetermined pitch in lines in the sub scan direction. The nozzle plate 30 is made of, for example, a silicon substrate or a metal plate, etc. As illustrated in FIG. 4, the nozzle plate 30 of the present embodiment has two nozzle lines (groups of nozzles) 36 made up of plural nozzles 35. The two nozzle lines 36 are provided adjacent to each other in the main scan direction. The ejection surface of the nozzle plate 30, from the nozzles 35 of which ink is ejected, is the nozzle surface 34. In other words, the nozzle surface 34 has plural nozzles 35. In the present embodiment, the recording head 2 has four head units 20, and the nozzle plate 30 of each of the four head units 20 has two nozzle lines 36. This means that the recording head 2 has eight nozzle lines 36 in total, adjacently in the main scan direction.

The flow passage substrate 31 has plural pressure compartments 37 corresponding to the nozzles 35. The pressure compartments 37 are separated from one another by partition walls, that is, compartmentalized. The flow passage substrate 31 has a common ink room 38 outside the array of pressure compartments 37. The common ink room 38 is in communication with each of the pressure compartments 37 via an ink supply port 42, the flow passage area of which is narrower than that of the common ink room 38. At the opposite side where the nozzle plate 30 is not provided, the common ink room 38 is in communication with an ink inlet passage 39, which is formed in the case 33. Because of this structure, ink coming from the ink cartridge 10 flows through the ink inlet passage 39 of the case 33 and then flows into the common ink room 38.

On the top of the flow passage substrate 31, that is, at the side that is the opposite of the side where the nozzle plate 30 is provided, piezoelectric elements 32 (a kind of actuator) are provided, with an elastic diaphragm plate 40 sandwiched therebetween. The piezoelectric element 32 has a layered structure that includes, for example, a lower electrode film made of metal, a piezoelectric layer made of lead zirconate titanate, etc., and an upper electrode film made of metal (none of them is illustrated). The piezoelectric element 32 is a so-called deflection-vibration-mode element. The piezoelectric element 32 is provided in such a way as to cover the ceiling of the pressure compartment 37. In the head unit 20 of the present embodiment, two lines of piezoelectric elements are provided adjacently to correspond to two nozzle lines 36. As viewed in the nozzle line direction, the piezoelectric elements 32 are arranged in a staggered layout to constitute the two piezoelectric element lines. Each of the piezoelectric elements 32 is configured to be deformable by receiving a drive signal, wherein the drive signal is applied to the piezoelectric element via a wiring member 41 such as a flexible cable from the printer controller 11. The deformation causes a pressure change in ink inside the pressure compartment 37 corresponding to the driven piezoelectric element 32. By controlling the pressure change in ink, it is possible to eject the ink from the nozzle 35.

Figure 5:
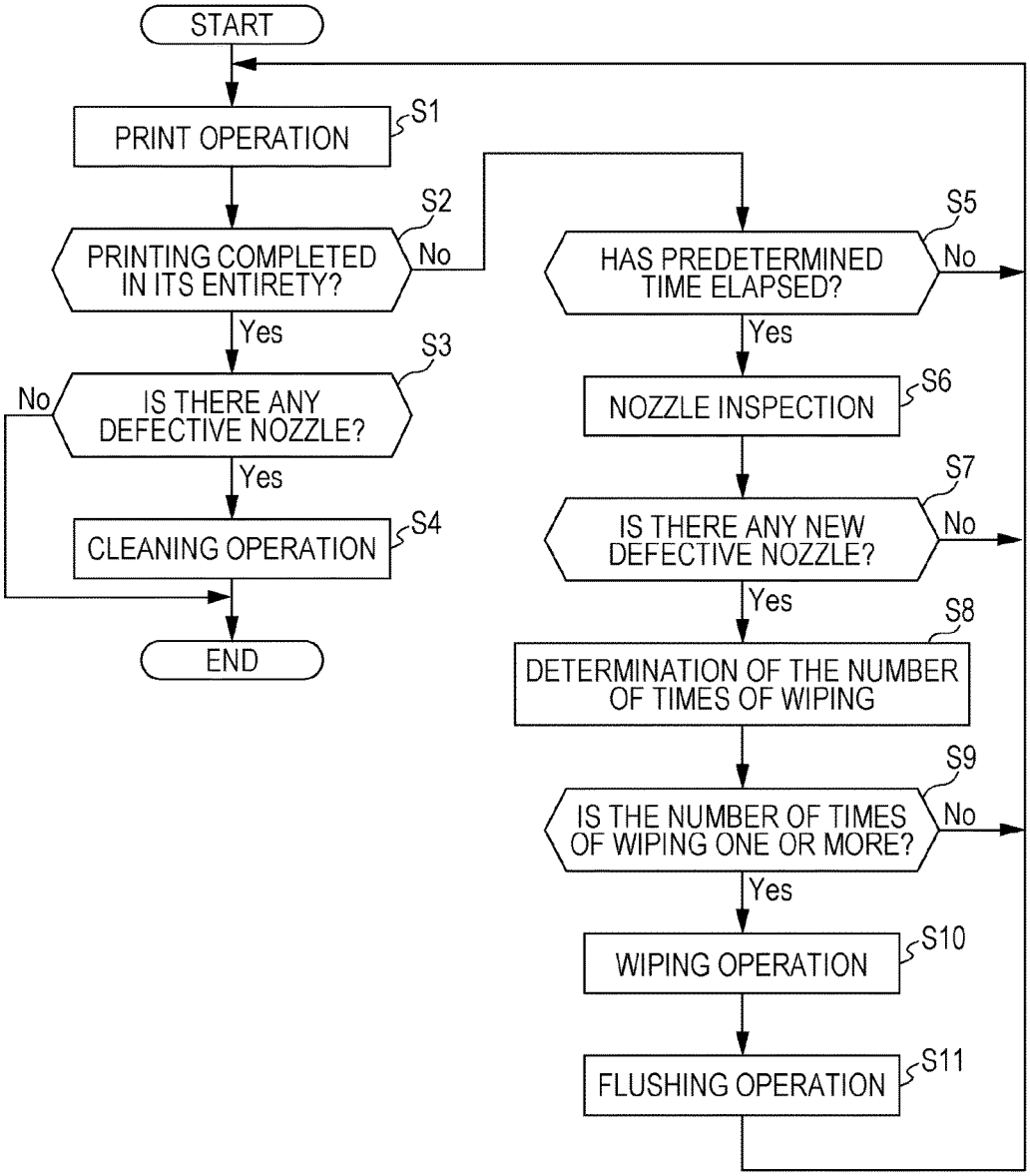
FIG. 5 is a flowchart for explaining an example of print operation performed by the printer.
Figure 6:
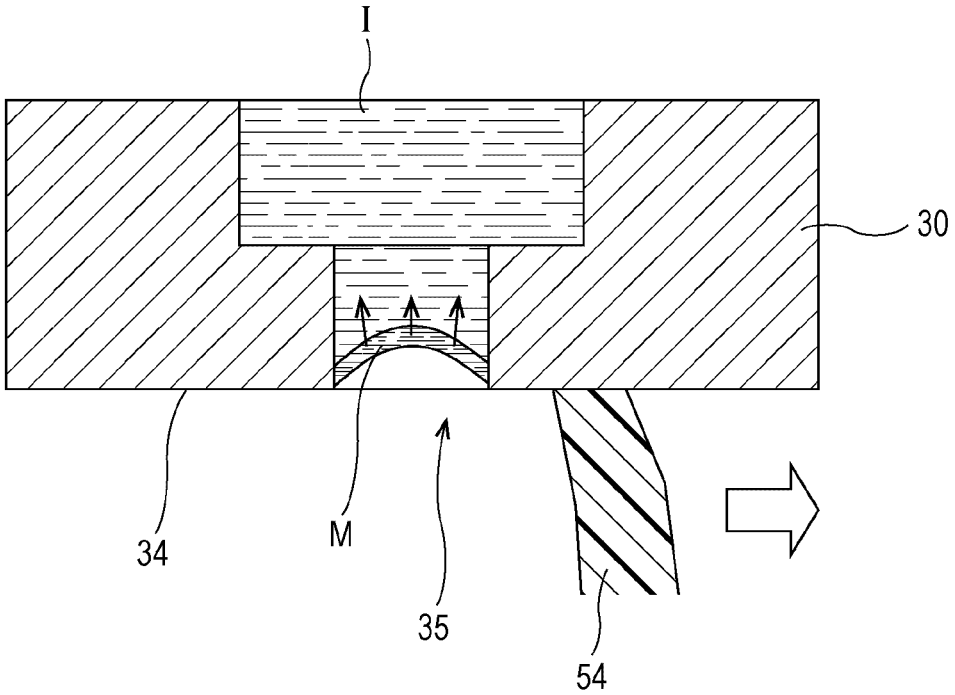
FIG. 6 is a schematic view for explaining an example of a process of wiping operation.

In liquid ejecting operation, ink is ejected from the nozzles 35 toward print paper for recording thereon (hereinafter referred to as print operation), wherein the printer 1 of the present embodiment is configured to, in a case of detection of a defective nozzle(s) by the nozzle inspection mechanism 8, suspend the print operation and causes the wiping mechanism 7 to perform wiping operation. That is, the printer 1 of the present embodiment has a drive method including wiping operation, in which the nozzle surface 34 is wiped by means of the wiper 54 impregnated with maintenance liquid, with the print operation suspended. The following is a more detailed explanation of print operation performed by the printer 1. FIG. 5 is a flowchart for explaining an example of print operation performed by the printer 1. FIG. 6 is a schematic view for explaining an example of a process of wiping operation.

Upon receiving print data such as image data and a print instruction from the external device 45, etc. by the control unit 13, the printer 1 starts print operation (step S1). After the lapse of predetermined time from the start of print operation, a nozzle inspection is performed (step S6). Specifically, in a case where printing has not been completed in its entirety yet (step S2: NO) and, in addition, where the predetermined time has elapsed from the start of print operation (step S5: YES), the print operation is suspended, and the nozzle inspection mechanism 8 performs nozzle inspection (step S6). The "start of print operation" mentioned herein encompasses the meaning of, but not limited to, a print start when print operation is resumed after a nozzle inspection, etc. That is, the nozzle inspection is performed at predetermined time intervals from the start of print operation. In a case where the predetermined time has not elapsed (step S5: NO), the print operation is continued without any suspension. The nozzle inspection may be performed without suspending the print operation. For example, the recording head 2 moves from the opposite side toward the home position, reverses its direction at the home position, and then moves from the home position toward the opposite side, wherein, during this operation, the recording head 2 may eject ink over the home position to perform the nozzle inspection. In a case where any new defective nozzle (assuming that the nozzle inspection is not the first inspection, defective nozzle whose defective status was not detected in the preceding nozzle inspection) has been found as a result of the nozzle inspection (step S7: YES), the process proceeds to a series of wiping steps (steps S8, 9, and 10), in which the nozzle surface 34 is wiped by means of the wiper 54 impregnated with maintenance liquid. In a case where no new defective nozzle has been found as a result of the nozzle inspection (step S7: NO), the print operation is continued.

In the wiping steps of the present embodiment, the amount of maintenance liquid put into the nozzles 35 is adjusted by changing the number of times of wiping the nozzle surface 34 depending on the length of time from the detection of the new defective nozzle by the nozzle inspection mechanism 8 to the scheduled completion of the print operation. Specifically, upon a judgement based on the inspection signal from the nozzle inspection mechanism 8 that there is a new defective nozzle, the control unit 13 calculates, on the basis of the print data, the time from the current point in time to the scheduled completion of the print operation, and determines the number of times of wiping the nozzle surface 34 depending on the calculated time (step S8). "Wiped once" means that the wiper 54 is moved from one end to the other end (or from the other end to one end) of the bottom surface of the recording head 2 in the main scan direction. For example, in a case where the time till the end of the print operation is two to three hours, the number of times of wiping the bottom surface of the recording head 2 (nozzle surface 34) is determined to be four (meaning that the reciprocation of the wiper 54 is performed twice). In a case where the time left is one to two hours, the number of times of wiping operation is determined to be three (i.e., wiped three times). In a case where the time left is thirty minutes to one hour, the number of times of wiping operation is determined to be two (meaning that the reciprocation of the wiper 54 is performed once). In a case where the time left is five to thirty minutes, the number of times of wiping operation is determined to be one. In a case where the time left is less than five minutes, the number of times of wiping operation is determined to be zero, which means no wiping of the bottom surface of the recording head 2 (nozzle surface 34). Since the wiping operation is not performed in this case, the print operation is resumed immediately (step S9: NO).

If it is judged that the number of times of wiping operation is one or more (step S9: YES), the control unit 13 causes the recording head 2 to move to the position over the wiping mechanism 7, and causes the wiping mechanism 7 to perform wiping operation (step S10). Specifically, as illustrated in FIG. 6, the control unit 13 activates the wiping mechanism 7 to bring the wiper 54 into contact with the nozzle surface 34 (or the bottom surface of the recording head 2). Then, in this state, the wiper 54 is moved in relation to the nozzle surface 34 in accordance with the number of times of wiping operation determined by the control unit 13 (see the white arrow in FIG. 6). Before this operation, the maintenance liquid supply unit 55 was activated to wet the wiper 54 with maintenance liquid. Therefore, as illustrated in FIG. 6, maintenance liquid M enters the nozzle 35 after the passing of the wiper 54. In this way, it is possible to put the maintenance liquid M into the nozzle 35. The larger the number of times of wiping the nozzle surface 34, the larger the amount of the maintenance liquid M put into the nozzle 35. That is, the longer the print completion time calculated by the control unit 13, the larger the amount of the maintenance liquid M put into the nozzle 35. Since the maintenance liquid M of the present embodiment is a liquid that contains a surface-active agent, it is possible to increase the amount of a surface-active agent contained in ink I in the nozzle 35 (and ink I in the pressure compartment 37) and suppresses the solidification of ink. In particular, the maintenance liquid M diffuses into the ink I in the nozzle 35, etc. (see the arrows in FIG. 6) because the surface-active agent contained in the maintenance liquid of the present embodiment is the same material as the surface-active agent contained in the ink and blends in the ink. Moreover, the concentration of the surface-active agent contained in the maintenance liquid is higher than the concentration of the surface-active agent contained in the ink. Therefore, the surface-active agent reaches the every part of the nozzle 35, etc. After the wiping of the nozzle surface 34 the determined number of times, the wiper 54 is brought away from the nozzle surface 34 (the bottom surface of the recording head 2), and the process proceeds to a flushing step (step S11).

In the flushing step, flushing operation, in which ink is ejected from the nozzles 35 toward an area outside the area of print paper, is performed. Specifically, the recording head 2 is moved to a position over the capping mechanism 6, and the piezoelectric elements 32 are driven, thereby ejecting ink from the nozzles 35 into the inner space of the cap 51. When this operation is performed, it is expected that, among the defective nozzles, defective nozzles that are in a state of being unable to discharge ink (liquid) at all will fail to perform ejection at least immediately after the wiping step even though the piezoelectric elements 32 are driven, resulting in that the maintenance liquid remains inside the nozzles 35. In contrast, among the defective nozzles, from defective nozzles that are in a state of being unable to eject ink straight or in a state of ejecting less than a predetermined amount of ink, at least a part of the maintenance liquid will be discharged in the flushing step, diminishing the effect of the maintenance liquid. For this reason, preferably, among the piezoelectric elements 32, those corresponding to the defective nozzles should not be driven so as to intentionally avoid ink from being ejected from the defective nozzles. By this means, it is possible to keep the maintenance liquid inside the defective nozzles. On the other hand, ink ejection is performed from normal nozzles 35 other than the defective nozzles, and, as a result, a mixture of the ink and the maintenance liquid, that is, the ink that has increased surface-active agent content, is discharged from the normal nozzles 35. By this means, it is possible to prevent ink that is to be ejected in subsequent print operation from substantially containing the maintenance liquid. Consequently, the quality of an image printed on print paper will not be decreased. After the end of the flushing operation, the process returns to the step S1, and print operation is resumed. In the print operation, similarly to the flushing step, ink is not ejected properly from the defective nozzles. Preferably, similarly to the procedure described above, among the piezoelectric elements 32, those corresponding to the defective nozzles should not be driven so as to intentionally avoid ink from being ejected from the defective nozzles. The step S1 of performing print operation before wiping operation (wiping step) corresponds to a first liquid ejection according to an aspect of the invention, and the step S1 of performing print operation after wiping operation (wiping step) (in the present embodiment, after flushing operation (flushing step)) corresponds to a second liquid ejection according to an aspect of the invention.

Upon completion of printing in its entirety (step S2: YES), it is judged whether there is any defective nozzle or not (step S3). In a case where there is not any defective nozzle or in a case where no nozzle inspection has been performed (step S3: NO), the operation of the printer 1 is terminated without performing any cleaning operation. In a case where there is at least one defective nozzle found in the nozzle inspection (step S3: YES), cleaning operation is performed (step S4). Specifically, the recording head 2 is moved to a position over the capping mechanism 6, and the cap 51 is put into a capping state. In this state, the pump unit 52 is driven to make the pressure of the inner space of the cap 51 negative, thereby forcibly discharging a large amount of ink (specifically, ink whose amount is larger than the amount of ink discharged in flushing operation) from the nozzle 35. Therefore, ink that has increased viscosity, a foreign object, an air bubble, or the like is discharged from the defective nozzle, and the function of the defective nozzle recovers to that of a normal nozzle 35. After the end of the cleaning operation, the operation of the printer 1 is terminated.

In print operation according to related art, since no ink is ejected from a so-called defective nozzle in a case of the occurrence of a defective nozzle phenomenon, the thickening of ink inside the defective nozzles progresses till the end of the print operation, and, in some cases, the ink solidifies in the nozzle and in the neighborhood thereof. There is a possibility that, as a result, the function recovery of the defective nozzle is difficult, or even impossible, when cleaning operation is performed after the print operation. If cleaning operation, which will take longer than wiping operation and flushing operation, is performed by suspending the print operation, the time till the end of the print operation will be longer due to a delay caused by the cleaning operation. In a case where an image, etc. is recorded by ejecting ink continuously onto an elongated print medium, etc., if print suspension time is long, there is a possibility that a long suspension gives rise to a discontinuity in the degree of drying of ink between an area having been printed before the cleaning and an area having been printed after the cleaning, resulting in the lack of uniformity in a print image. However, the printer 1 of the present embodiment performs, before the end of print operation, wiping operation to put maintenance liquid into the nozzles 35; therefore, it is possible to put the maintenance liquid (specifically, a surface-active agent) into the defective nozzle. By this means, it is possible to increase the amount of the surface-active agent contained in the ink in the defective nozzle. As a result, even if the thickening of the ink in the defective nozzle progresses thereafter till the end of the print operation, it is easier for the thickened ink or foreign object, etc. to be released from the wall surface, etc. of the nozzle 35, thereby suppressing the deterioration of recovery performance of the defective nozzle in the cleaning operation performed after the print operation. As compared with a case where cleaning operation is performed before the end of print operation, it is possible to shorten operation time from the start to the end of the print operation. Moreover, because print suspension time is short, even in a case where an image, etc. is recorded by ejecting ink continuously onto an elongated print medium, etc., it is possible to avoid the lack of image uniformity.

In the present embodiment, in a case where a defective nozzle is detected by the nozzle inspection mechanism 8, wiping operation is performed. Therefore, it is possible to suppress the deterioration of the performance of the function recovery of the defective nozzle which would otherwise occur when the defective nozzle is left unattended (i.e., not wiped) for a long time. Furthermore, since wiping operation is not performed in a case of absence of a defective nozzle, it is possible to shorten the operation time of print operation. Furthermore, in the present embodiment, the amount of maintenance liquid put into the nozzles 35 in the wiping step is adjusted depending on the length of time from the detection of the defective nozzle by the nozzle inspection mechanism 8 to the scheduled completion of the print operation; therefore, it is possible to reduce the consumption of the maintenance liquid.

Figure 7:
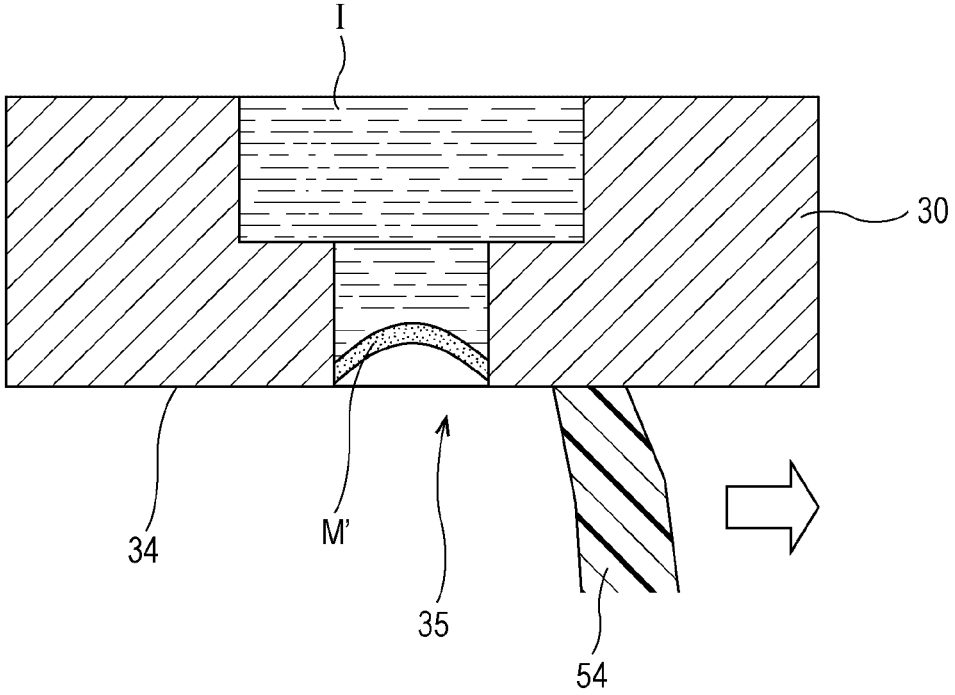
FIG. 7 is a schematic view for explaining an example of a process of wiping operation according to a second embodiment.

In the first embodiment described above, a liquid that contains a surface-active agent is used as the maintenance liquid. However, the maintenance liquid is not limited to the foregoing example. In a printer 1 according to a second embodiment, a liquid that is less volatile than ink and does not mix well with ink is used as the maintenance liquid. FIG. 7 is a schematic view for explaining an example of a process of wiping operation according to a second embodiment.

In wiping operation using such a maintenance liquid, the nozzle surface 34 is wiped by means of the wiper 54 that is wet with the maintenance liquid, wherein the number of times of wiping operation is determined by the control unit 13, as done in the first embodiment. Therefore, as illustrated in FIG. 7, maintenance liquid M' enters the nozzle 35. It is possible to put the maintenance liquid M' into the nozzle 35 in this way. The maintenance liquid M of the present embodiment is a liquid that is less volatile than ink and does not mix well with ink. Therefore, it is possible to keep the maintenance liquid M' on the surface (meniscus) of ink I in the nozzle 35. Therefore, the ink I in the nozzle 35 becomes coated with the maintenance liquid M'. The coating protection reduces the vaporization of the ink from the defective nozzle. In the flushing step, flushing operation is performed as done in the first embodiment. As a result, ink ejection is performed from normal nozzles 35 other than the defective nozzles, and the maintenance liquid M' also goes out from the nozzles 35. Regarding the defective nozzle, if a pressure change is applied to the liquid in the pressure compartment for liquid ejection, disadvantageously, the maintenance liquid M' will be discharged from the nozzle 35, or the maintenance liquid M' will be agitated to mix with the ink I, which makes it impossible to keep the maintenance liquid M' on the surface (meniscus) of ink I in the nozzle 35. Therefore, preferably, ink ejection from the defective nozzle should be intentionally avoided. The maintenance liquid M' in the defective nozzle 35 is forcibly discharged together with the ink in cleaning operation (step S4).

Consequently, it is possible to retard the thickening of the ink in the defective nozzle and suppress the deterioration of recovery performance of the defective nozzle in the cleaning operation performed after the print operation. That is, the maintenance liquid M' of the present embodiment is, similarly to the maintenance liquid M of the first embodiment, a liquid with which it is possible to suppress the deterioration of recovery performance of a so-called defective nozzle. Examples of the maintenance liquid M' include, but not limited to, an oil-based liquid and a liquid that is more viscous than ink (the higher the viscosity, the lower the fluidity). Except for the above differences, the operation and structure of the printer 1 are the same as those in the first embodiment. Therefore, they are not explained here.

In wiping operation according to each of the foregoing embodiments, the blade-shaped wiper 54 that is elongated in the direction of the nozzle lines is moved relatively in the main scan direction to wipe the nozzle surface 34. However, the wiping operation is not limited to the foregoing example. For example, a structure for wiping the nozzle surface 34 by moving, relatively in the direction of the nozzle lines, a blade-shaped wiper that is elongated in the direction orthogonal to the direction of the nozzle lines may be adopted. Alternatively, a structure for individually wiping the nozzle surface 34 of each of the head units 20 provided adjacently in the recording head 2 may be adopted.

Figure 8:
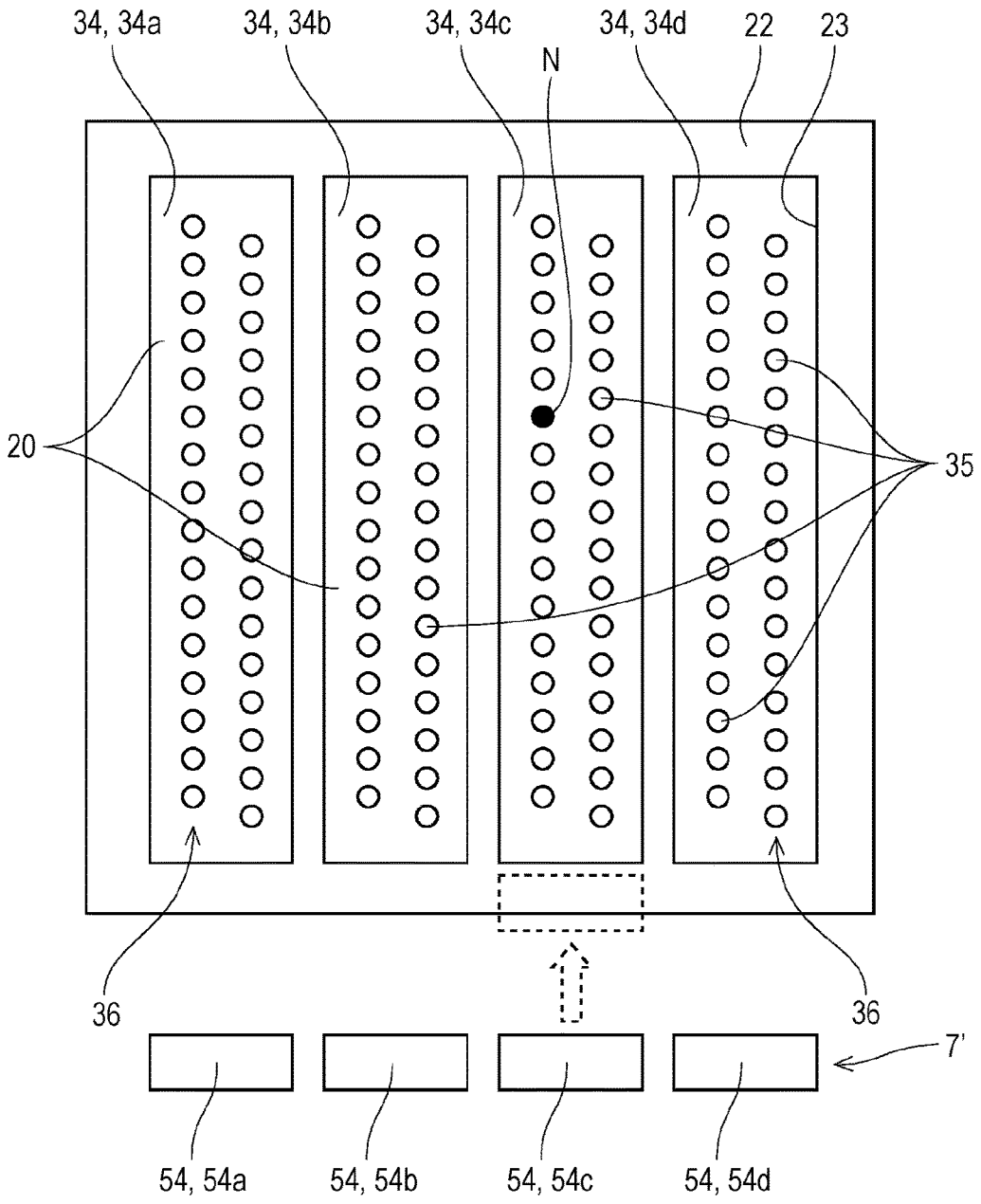
FIG. 8 is a schematic view for explaining an example of a process of wiping operation according to a third embodiment.

For example, in a third embodiment illustrated in FIG. 8, plural blade-shaped wipers 54 corresponding to the nozzle surface 34 of the respective head units 20 are provided, in the direction orthogonal to the direction of the nozzle lines. Four head units 20 are arranged adjacent to one another in the main scan direction, and four open regions of the nozzle surface 34, that is, the regions exposed respectively through the four openings 23 of the fixing plate 22, are arranged adjacent to one another in the main scan direction. Therefore, four wipers 54 are provided adjacent to one another in the main scan direction to correspond to these exposed regions of the nozzle surface. That is, as illustrated in FIG. 8, the wiping mechanism 7' includes four wipers 54*a* to 54*d* corresponding to four nozzle surface regions 34*a* to 34*d*. Each of the wipers 54*a* to 54*d* is able to be moved in the direction of the nozzle lines independently of the others. Other structure in the present embodiment is the same as that in the first embodiment. Therefore, it is not explained here.

In wiping operation performed by the printer 1 having the structure described above, among the four nozzle surface regions 34*a* to 34*d*, only a nozzle surface region(s) in which a defective nozzle(s) has been found is wiped. Assume a case where, for example, a defective nozzle N is found in the nozzle surface region 34*c* in the process of nozzle inspection (step S6). In this case, the wiper 54*c* only, which corresponds to the nozzle surface region 34*c*, is moved to wipe the nozzle surface region 34*c* only. Specifically, the wiping mechanism 7' is activated so as to move the wipers 54*a* to 54*d* to a position where they are able to be brought into contact with the nozzle surface regions 34*a* to 34*d* of the recording head 2. Before this operation, the maintenance liquid supply unit 55 was activated to supply maintenance liquid to the wiper 54*c* only. In this state, the wiper 54*c* is moved in the direction of the nozzle lines (see the broken-line arrow in FIG. 8). Therefore, it is possible to wipe the nozzle surface region 34*c* only, which has the defective nozzle N, and to put the maintenance liquid into the nozzles 35 of the nozzle surface region 34*c* only. By this means, it is possible to reduce the consumption of the maintenance liquid. Moreover, since the maintenance liquid is not put into the nozzles 35 of the other nozzle surface regions 34*a*, 34*b*, and 34*d*, it is possible to more reliably prevent ink that is to be ejected from these nozzles 35 in subsequent print operation from containing the maintenance liquid. In addition, in flushing operation that is performed after the wiping operation, ink is ejected from the nozzles 35 of the nozzle surface region 34*c* only. By this means, it is possible to reduce the consumption of the ink in the head units 20 that do not have any defective nozzle N. Except for the above differences, the operation and structure of the printer 1 are the same as those in the first embodiment. Therefore, they are not explained here.

In the embodiments described above, the nozzle inspection is performed by the nozzle inspection mechanism 8 at predetermined time intervals. However, the scope of the disclosure is not limited to the foregoing example. For example, wiping operation of putting the maintenance liquid into the nozzles 35 may be performed at predetermined time intervals irrespective of whether there is any defective nozzle or not. In the embodiments described above, the number of times of wiping the nozzle surface 34 varies depending on the length of time from the detection of the defective nozzle by the nozzle inspection mechanism 8 to the scheduled completion of the print operation. However, the scope of the disclosure is not limited to the foregoing example. Wiping the nozzle surface 34 at least once suffices. In the embodiments described above, flushing operation is performed after wiping operation of putting the maintenance liquid into the nozzles 35. However, the scope of the disclosure is not limited to the foregoing example. In a case where a type of maintenance liquid that has little influence on image quality is used or where a decrease in image quality to some extent is tolerable, print operation may be performed immediately after wiping operation without performing flushing operation.

In the embodiments described above, upon completion of the entire print operation, it is judged whether there is any defective nozzle or not, and cleaning operation is performed in a case where there is at least one defective nozzle found in the nozzle inspection. However, the scope of the disclosure is not limited to the foregoing example. Cleaning operation may be performed irrespective of whether there is any defective nozzle or not, for example, at predetermined time intervals or for every predetermined print jobs. The number of the wiping mechanism 7 of the printer 1 is not limited to one. For example, the printer 1 may include a wiping mechanism equipped with a wiper(s) to which maintenance liquid that contains a surface-active agent is supplied as in the first embodiment and further include a wiping mechanism equipped with a wiper(s) to which maintenance liquid that is less volatile than ink and does not mix well with (does not blend in) ink is supplied as in the second embodiment. In wiping operation, either one of the two wiping mechanisms may be used, or both of the two wiping mechanisms may be used. In the latter case, the wiping operation of putting the maintenance liquid that contains the surface-active agent into the nozzles is performed first, followed by the wiping operation of putting the maintenance liquid that is less volatile than the ink and does not mix well with (does not blend in) the ink into the nozzles. The maintenance liquid does not necessarily have to contain pigment or resin, as long as it is capable of suppressing the deterioration of recovery performance of so-called defective nozzle, from which ink is not ejected properly.

In the third embodiment, the wipers 54*a* to 54*d*, each as an individual wiper, are provided respectively for the nozzle surface regions 34*a* to 34*d* so as to be able to wipe the nozzle surface regions 34*a* to 34*d* independently of one another. However, the scope of the disclosure is not limited to the foregoing example. For example, an individual wiper may be provided for each of nozzle lines 36 so that the nozzle lines 36 will be able to be wiped independently of one another. In the embodiments described above, the piezoelectric element 32 that is a so-called deflection-vibration-mode element is described as an example of an actuator that gives rise to a pressure change in the ink inside the pressure compartment 37. However, the scope of the disclosure is not limited to the foregoing example. Various kinds of actuator can be adopted, for example, a so-called longitudinal-vibration piezoelectric element, a heat generation element, or an electrostatic actuator, which changes the capacity of a pressure compartment by utilizing an electrostatic force. Though a so-called serial head that ejects ink while being scanned (reciprocating) in the direction (main scan direction) orthogonal to the direction in which a recording target medium is transported (sub scan direction) is described as an example of the recording head 2, the scope of the disclosure is not limited thereto. Aspects of the invention may be applied to a printer equipped with a so-called line head that has a recording head array in the medium width direction.

An ink-jet recording apparatus 1 is taken as an example of a liquid ejecting apparatus in the foregoing description. However, aspects of the invention may be applied to other types of liquid ejecting apparatus. Examples of the application of aspects of the invention, without any limitation thereto, are: a liquid ejecting apparatus equipped with a color material ejecting head used for manufacturing a color filter for a liquid crystal display, etc., a liquid ejecting apparatus equipped with an electrode material ejecting head used for forming electrodes of an organic EL (electroluminescence) display or an FED (surface/plane emission display), etc., and a liquid ejecting apparatus equipped with a living organic material ejecting head used for producing biochips (biochemical element). A color material ejecting head of a machine for manufacturing display devices ejects, as a kind of liquid, a solution of R (red), G (green), and B (blue) colorants. An electrode material ejecting head of a machine for forming electrodes ejects, as a kind of liquid, an electrode material that is in liquid form. A living organic material ejecting head of a machine for producing biochips ejects, as a kind of liquid, a solution of bioorganic substances.

The entire disclosure of Japanese Patent Application No. 2016-185195, filed Sep. 23, 2016, is expressly incorporated by reference herein.

What is claimed is:

1. A liquid ejecting apparatus driving method for driving a liquid ejecting apparatus, the apparatus including a liquid ejecting head, a wiper, and a maintenance liquid supply mechanism, the liquid ejecting head having nozzles in a nozzle surface, pressure compartments communicating with the nozzles, and actuators corresponding to the pressure compartments, and configured to eject a liquid from the nozzles communicating with the pressure compartments corresponding to the driven actuators, the wiper configured to wipe the nozzle surface, and the maintenance liquid supply mechanism configured to supply a maintenance liquid to suppress deterioration of recovery performance of, among the nozzles, defective nozzles from which the liquid is not ejected properly, the method comprising:

performing a liquid ejecting operation to eject the liquid from the nozzles toward a medium;

putting the maintenance liquid into the nozzles by wiping the nozzle surface by means of the wiper, with the liquid ejecting operation suspended; and resuming the liquid ejecting operation after the wiping using the nozzles, exclusive of the nozzles identified as being defective nozzles, wherein the actuators corresponding to the pressure compartments communicating with the defective nozzles are not driven such that the maintenance liquid remains in the defective nozzles until a subsequent cleaning operation.

2. The liquid ejecting apparatus driving method according to claim 1, wherein the liquid ejecting apparatus further includes a nozzle inspection mechanism configured to detect the defective nozzle from which the liquid is not ejected properly; and wherein the nozzle surface is wiped by the wiper in a case where the defective nozzle is detected by the nozzle inspection mechanism.

3. The liquid ejecting apparatus driving method according to claim 2, wherein an amount of the maintenance liquid put into the nozzles in the wiping is adjusted depending on a length of time from the detection of the defective nozzle by the nozzle inspection mechanism to scheduled completion of the liquid ejecting operation onto the medium.

4. The liquid ejecting apparatus driving method according to claim 2, further comprising:

performing a flushing operation to eject the liquid from the nozzles toward an area outside an area of the medium after the wiping and before the resurgence in the liquid ejection operation after the wiping, wherein, in the flushing operation, the actuators corresponding to the pressure compartments communicating the defective nozzles are not driven to not eject the liquid from the defective nozzles.

5. A liquid ejecting apparatus driving method for driving a liquid ejecting apparatus, the apparatus including a liquid ejecting head, a wiper, and a maintenance liquid supply mechanism, the liquid ejecting head having nozzles in a nozzle surface, pressure compartments communicating with the nozzles, and actuators corresponding to the pressure compartments, and configured to eject a liquid from the nozzles communicating with the pressure compartments corresponding to the driven actuators, the wiper configured to wipe the nozzle surface, and the maintenance liquid supply mechanism configured to supply a maintenance liquid that contains a surface-active agent, the method comprising:

performing a liquid ejecting operation to eject the liquid from the nozzles toward a medium;

putting the maintenance liquid into the nozzles by wiping the nozzle surface by means of the wiper, with the liquid ejecting operation suspended; and resuming the liquid ejecting operation after the wiping using the nozzles, exclusive of the nozzles identified as being defective nozzles, wherein the actuators corresponding to the pressure compartments communicating the defective nozzles are not driven such that the maintenance liquid remains in the defective nozzles until a subsequent cleaning operation.

6. The liquid ejecting apparatus driving method according to claim 5, wherein the liquid contains a surface-active agent;

wherein the surface-active agent contained in the maintenance liquid is the same material as the surface-active agent contained in the liquid; and wherein concentration of the surface-active agent contained in the maintenance liquid is higher than concentration of the surface-active agent contained in the liquid.

7. The liquid ejecting apparatus driving method according to claim 5, wherein the liquid ejecting apparatus further includes a nozzle inspection mechanism configured to detect the defective nozzle from which the liquid is not ejected properly; and wherein the nozzle surface is wiped by the wiper in a case where the defective nozzle is detected by the nozzle inspection mechanism.

8. The liquid ejecting apparatus driving method according to claim 7, wherein an amount of the maintenance liquid put into the nozzles in the wiping is adjusted depending on a length of time from the detection of the defective nozzle by the nozzle inspection mechanism to scheduled completion of the liquid ejecting operation onto the medium.

9. The liquid ejecting apparatus driving method according to claim 7, further comprising:

performing a flushing operation to eject the liquid from the nozzles toward an area outside an area of the medium after the wiping and before the resurgence in the liquid ejection operation after the wiping, wherein, in the flushing operation, the actuators corresponding to the pressure compartments communicating the defective nozzles are not driven to not eject the liquid from the defective nozzles.

10. A liquid ejecting apparatus driving method for driving a liquid ejecting apparatus, the apparatus including a liquid ejecting head, a wiper, and a maintenance liquid supply mechanism, the liquid ejecting head having nozzles in a nozzle surface, pressure compartments communicating with the nozzles, and actuators corresponding to the pressure compartments, and configured to eject a liquid from the nozzles communicating with the pressure compartments corresponding to the driven actuators, the wiper configured to wipe the nozzle surface, and the maintenance liquid supply mechanism configured to supply a maintenance liquid that is less volatile than the liquid and does not mix well with the liquid, the method comprising:

performing a liquid ejecting operation to eject the liquid from the nozzles toward a medium;

putting the maintenance liquid into the nozzles by wiping the nozzle surface by means of the wiper, with the liquid ejecting operation suspended; and resuming the liquid ejecting operation after the wiping using the nozzles, exclusive of the nozzles identified as being defective nozzles, wherein the actuators corresponding to the pressure compartments communicating the defective nozzles are not driven such that the maintenance liquid remains in the defective nozzles until a subsequent cleaning operation.

11. The liquid ejecting apparatus driving method according to claim 10, wherein the liquid ejecting apparatus further includes a nozzle inspection mechanism configured to detect the defective nozzle from which the liquid is not ejected properly; and wherein the nozzle surface is wiped by the wiper in a case where the defective nozzle is detected by the nozzle inspection mechanism.

12. The liquid ejecting apparatus driving method according to claim 11, wherein an amount of the maintenance liquid put into the nozzles in the wiping is adjusted depending on a length of time from the detection of the defective nozzle by the nozzle inspection mechanism to scheduled completion of the liquid ejecting operation onto the medium.

13. The liquid ejecting apparatus driving method according to claim 11, further comprising:

performing a flushing operation to eject the liquid from the nozzles toward an area outside an area of the medium after the wiping and before the resurgence in the liquid ejection operation after the wiping, wherein, in the flushing operation, the actuators corresponding to the pressure compartments communicating the defective nozzles are not driven to not eject the liquid from the defective nozzles.

14. A liquid ejecting apparatus, comprising:

a liquid ejecting head that has nozzles in a nozzle surface, pressure compartments communicating with the nozzles, and actuators corresponding to the pressure compartments, and that are configured to eject a liquid from the nozzles communicating with the pressure compartments corresponding to the driven actuators;

a wiper that is configured to wipe the nozzle surface in a state that the liquid ejecting head suspends a liquid ejecting operation of ejecting the liquid the nozzles toward a medium;

a maintenance liquid supply mechanism that is configured to supply, either to the nozzle surface or to the wiper, or to both, a maintenance liquid to suppress deterioration of recovery performance of, among the nozzles, defective nozzles from which the liquid is not ejected properly, the maintenance liquid being put into the nozzles by wiping the nozzle surface by means of the wiper, and the liquid ejecting head resuming the liquid ejecting operation after the maintenance liquid being put into the defective nozzles; and a head control unit, wherein in the resumed liquid ejecting operation, the actuators corresponding to the pressure compartments communicating the defective nozzles are not driven by the head control unit such that the maintenance liquid remains in the defective nozzles until a subsequent cleaning operation.

15. The liquid ejecting apparatus according to claim 14, further comprising:

a nozzle inspection mechanism configured to detect the defective nozzle from which the liquid is not ejected properly, wherein the nozzle surface is wiped by the wiper in a case where the defective nozzle is detected by the nozzle inspection mechanism.

16. A liquid ejecting apparatus, comprising:

a liquid ejecting head that has nozzles in a nozzle surface, pressure compartments communicating with the nozzles, and actuators corresponding to the pressure compartments, and that is configured to eject a liquid from the nozzles communicating with the pressure compartments corresponding to the driven actuators;

a wiper that is configured to wipe the nozzle surface in a state that the liquid ejecting head suspends a liquid ejecting operation of ejecting the liquid from the nozzles toward a medium;

a maintenance liquid supply mechanism that is configured to supply, either to the nozzle surface or to the wiper, or to both, a maintenance liquid that contains a surface-active agent, the maintenance liquid being put into the nozzles by wiping the nozzle surface by means of the wiper, and the liquid ejecting head resuming the liquid ejecting operation after the maintenance liquid being put into the defective nozzles; and a head control unit, wherein in the resumed liquid ejecting operation, the actuators corresponding to the pressure compartments communicating the defective nozzles are not driven by the head control unit such that the maintenance liquid remains in the defective nozzles until a subsequent cleaning operation.

17. The liquid ejecting apparatus according to claim 16, wherein the liquid contains a surface-active agent;

wherein the surface-active agent contained in the maintenance liquid is the same material as the surface-active agent contained in the liquid; and wherein concentration of the surface-active agent contained in the maintenance liquid is higher than concentration of the surface-active agent contained in the liquid.

18. The liquid ejecting apparatus according to claim 16, further comprising:

a nozzle inspection mechanism configured to detect the defective nozzle from which the liquid is not ejected properly, wherein the nozzle surface is wiped by the wiper in a case where the defective nozzle is detected by the nozzle inspection mechanism.

19. A liquid ejecting apparatus, comprising:

a liquid ejecting head that has nozzles in a nozzle surface, pressure compartments communicating with the nozzles, and actuators corresponding to the pressure compartments, and that is configured to eject a liquid from the nozzles;

a wiper that is configured to wipe the nozzle surface in a state that the liquid ejecting head suspends a liquid ejecting operation of ejecting the liquid the nozzles toward a medium; and a maintenance liquid supply mechanism that is configured to supply, either to the nozzle surface or to the wiper, or to both, a maintenance liquid that is less volatile than the liquid and does not mix well with the liquid, the maintenance liquid being put into the nozzles by wiping the nozzle surface by means of the wiper, and the liquid ejecting head resuming the liquid ejecting operation after the maintenance liquid being put into the defective nozzles; and a head control unit, wherein in the resumed liquid ejecting operation, the actuators corresponding to the pressure compartments communicating the defective nozzles are not driven by the head control unit such that the maintenance liquid remains in the defective nozzles until a subsequent cleaning operation.

20. The liquid ejecting apparatus according to claim 19, further comprising:

a nozzle inspection mechanism configured to detect the defective nozzle from which the liquid is not ejected properly, wherein the nozzle surface is wiped by the wiper in a case where the defective nozzle is detected by the nozzle inspection mechanism.

* * * * *